US011248280B2

(12) United States Patent
Delgrange et al.

(10) Patent No.: US 11,248,280 B2
(45) Date of Patent: Feb. 15, 2022

(54) ALUMINIUM ALLOY VACUUM CHAMBER ELEMENTS STABLE AT HIGH TEMPERATURE

(71) Applicant: CONSTELLIUM ISSOIRE, Issoire (FR)

(72) Inventors: Guillaume Delgrange, Grenoble (FR); Christophe Chabriol, Champier (FR); Romain-Fabrice Bernes, Issoire (FR)

(73) Assignee: CONSTELLIUM ISSOIRE, Issoire (FR)

( * ) Notice: Subject to any disclaimer, the term of this patent is extended or adjusted under 35 U.S.C. 154(b) by 330 days.

(21) Appl. No.: 16/492,085

(22) PCT Filed: Mar. 1, 2018

(86) PCT No.: PCT/FR2018/050481
§ 371 (c)(1),
(2) Date: Sep. 6, 2019

(87) PCT Pub. No.: WO2018/162823
PCT Pub. Date: Sep. 13, 2018

(65) Prior Publication Data

US 2021/0130933 A1 May 6, 2021

(30) Foreign Application Priority Data

Mar. 10, 2017 (FR) ..... 1751981

(51) Int. Cl.

| | |
|---|---|
| ***C22C 21/08*** | (2006.01) |
| ***C22C 21/02*** | (2006.01) |
| ***C22F 1/043*** | (2006.01) |
| ***C22F 1/05*** | (2006.01) |
| ***C25D 11/08*** | (2006.01) |
| ***C25D 11/10*** | (2006.01) |

(52) U.S. Cl.
CPC ..... *C22C 21/08* (2013.01); *C22C 21/02* (2013.01); *C22F 1/043* (2013.01); *C22F 1/05* (2013.01); *C25D 11/08* (2013.01); *C25D 11/10* (2013.01)

(58) Field of Classification Search
CPC ..... C22C 21/08; C22C 21/02; C25D 11/10; C25D 11/08; C22F 1/05; C22F 1/043
See application file for complete search history.

(56) References Cited

U.S. PATENT DOCUMENTS

| | | | |
|---|---|---|---|
| 6,027,629 | A | 2/2000 | Hisamoto et al. |
| 6,066,392 | A | 5/2000 | Hisamoto et al. |
| 6,686,053 | B2 | 2/2004 | Wada et al. |
| 6,713,188 | B2 | 3/2004 | Wu et al. |
| 7,005,194 | B2 | 2/2006 | Wada et al. |
| 7,033,447 | B2 | 4/2006 | Lin et al. |
| 2001/0019777 | A1 | 9/2001 | Tanaka et al. |
| 2009/0050485 | A1 | 2/2009 | Wada et al. |
| 2010/0018617 | A1 | 1/2010 | Wada et al. |
| 2015/0255253 | A1 | 9/2015 | Van Kappel et al. |

FOREIGN PATENT DOCUMENTS

| | | | | |
|---|---|---|---|---|
| FR | 2996857 | A1 * | 4/2014 | ..... B01J 3/006 |
| JP | 2001220637 | A | 8/2001 | |
| WO | 2011/89337 | A1 | 7/2011 | |
| WO | 2014/060660 | A1 | 4/2014 | |

OTHER PUBLICATIONS

English Abstract of Davo et al. (FR 2996857) (Apr. 2014).*
International Search Report of International Patent Application No. PCT/FR2018/050481 dated May 8, 2018.
French Search Report and Written Opinion of French Patent Application No. 1751981 dated Nov. 29, 2017.
Mohri, M. et al., "Surface study of Type 6063 aluminium alloys for vacuum chamber materials", Vacuum, 1984, pp. 643-647, vol. 34, No. 6.

* cited by examiner

*Primary Examiner* — Jessee R Roe
(74) *Attorney, Agent, or Firm* — McBee Moore & Vanik IP, LLC

(57) ABSTRACT

The invention relates to a vacuum chamber element obtained by machining and surface treatment of a plate of thickness at least equal to 10 mm made of aluminium alloy composed as follows (as percentages by weight), Si: 0.4-0.7, Mg: 0.4-1.0; the Mg/Si ratio as a percentage by weight being less than 1.8; Ti: 0.01-0.15, Fe 0.08-0.25; Cu <0.35; Mn <0.4; Cr: <0.25; Zn <0.04; other elements <0.05 each and <0.15 in total, the rest aluminium, characterized in that the grain size of said plate is such that the mean linear intercept length $\bar{\ell}$, measured in plane L/TC according to standard ASTM E112, is at least equal to 350 μm between surface and ½ thickness. The invention also relates to the method of manufacturing of such a vacuum chamber element. The products according to the invention are particularly advantageous, particularly in terms of resistance to creep deformation at high temperature, while having high properties of corrosion resistance, homogeneity of properties in thickness and machinability.

20 Claims, 4 Drawing Sheets

ALUMINIUM ALLOY VACUUM CHAMBER ELEMENTS STABLE AT HIGH TEMPERATURE

CROSS-REFERENCE TO RELATED APPLICATIONS

This application is a National Stage entry of International Application No. PCT/FR2018/050481, filed 1 Mar. 2018, which claims priority to French Patent Application No. 1751981, filed 10 Mar. 2017.

BACKGROUND

Field

The invention relates to aluminium alloy products for use as vacuum chamber elements, in particular for the manufacture of integrated electronic circuits based on semiconductors, flat display screens and photovoltaic panels and their manufacturing process.

Description of Related Art

Vacuum chamber elements for the fabrication of integrated electronic circuits based on semiconductors, flat display screens and photovoltaic panels, can typically be obtained from aluminium alloy plates.

Vacuum chamber elements are elements for the manufacture of vacuum chamber structures and the internal components of the vacuum chamber, such as vacuum chamber bodies, valve bodies, flanges, connecting elements, sealing elements, diffusers and electrodes. They are in particular obtained by machining and surface treatment of aluminium alloy plates.

To obtain satisfactory vacuum chamber elements, the aluminium alloy plates must have certain properties.

The plates must first have satisfactory mechanical characteristics for machining parts with the desired dimensions and rigidity so as to be able to attain a vacuum generally of at least the level of the average vacuum ($10^{-3}$-$10^{-5}$ Torr) without deformation. The desired ultimate tensile strength ($R_m$) is therefore generally at least 260 MPa and even greater if possible. In addition, in order to be machinable the plates to be machined from a single block must have homogeneous thickness properties and have a low density of stored elastic energy from residual stresses. In addition, in certain applications, vacuum chamber elements are subjected to high temperatures and it is important that they should be highly resistant to creep deformation at high temperature.

The porosity level of the plates must also be sufficiently low in order to reach high-vacuum ($10^{-6}$-$10^{-8}$ Torr) if necessary. In addition, the gases used in vacuum chambers are frequently very corrosive and in order to avoid the risks of pollution of the silicon plates or liquid crystal devices by particles or substances coming from the vacuum chamber elements and/or frequent replacement of these elements, it is important to protect the surfaces of the vacuum chamber elements. Aluminium proves to be an advantageous material from this point of view because it is possible to carry out surface treatment producing a hard anodized oxide coating, resistant to reactive gases. This surface treatment comprises an anodizing stage and the oxide layer obtained is generally called an anodic layer. In the context of the invention, "corrosion resistance" is taken more specifically to mean the resistance of anodized aluminium to corrosive gases used in vacuum chambers and to the corresponding tests. However, the protection provided by the anodic layer is affected by many factors related in particular to the microstructure of the plate (grain size and shape, precipitation of phases and porosity) and it is always desirable to improve this parameter. Corrosion resistance can be evaluated by the test known as a "bubble test" which involves measuring the duration of occurrence of hydrogen bubbles on the surface of the anodized product upon contact with a dilute solution of hydrochloric acid. Durations known in prior art range from tens of minutes to several hours.

To improve the vacuum chamber elements, the aluminium plates and/or the surface treatment carried out can be improved.

U.S. Pat. No. 6,713,188 (Applied Materials Inc.) describes an alloy suitable for the manufacture of chambers for the manufacture of semiconductors composed as follows (as a percentage by weight): 0.4-0.8; Cu: 0.15-0.30; Fe: 0.001-0.20; Mn 0.001-0.14; Zn 0.001-0.15; Cr: 0.04-0.28; Ti 0.001-0.06; Mg: 0.8-1.2 The parts are obtained by extrusion or machining to reach the required shape. The composition makes it possible to check the size of the impurity particles which improves the performance of the anodic layer.

U.S. Pat. No. 7,033,447 (Applied Materials Inc.) claims an alloy suitable for the manufacture of chambers for the manufacture of semiconductors composed as follows (as a percentage by weight) Mg: 3.5-4.0; Cu: 0.02-0.07; Mn: 0.005-0.015; Zn 0.08-0.16; Cr 0.02-0.07; Ti: 0-0.02; Si <0.03; Fe <0.03. The parts are anodized in a solution comprising 10% to 20% of sulphuric acid by weight, and 0.5 to 3% by weight of oxalic acid at a temperature of 7-21° C. The best result obtained with the bubble test is 20 hours.

U.S. Pat. No. 6,686,053 (Kobe) claims an alloy having improved corrosion resistance, wherein the anode oxide comprises a barrier layer and a porous layer and wherein at least part of the layer has altered into boehmite and/or pseudo-boehmite. The best result obtained with the test bubble is of the order of 10 hours.

Patent application US 2009/0050485 (Kobe Steel, Ltd.) discloses an alloy composed as follows (as percentages by weight) Mg: 0.1-2.0; Si: 0.1-2.0; Mn: 0.1-2.0; Fe, Cr, and Cu ≤0.03, anodized so that the hardness of the anodic oxide layer varies in thickness. The very low iron, chromium and copper content leads to high extra cost for the metal used.

Patent application US 2010/0018617 (Kobe Steel, Ltd.) discloses an alloy composed as follows (as percentages by weight) Mg: 0.1-2.0; Si: 0.1-2.0; Mn: 0.1-2.0; Fe, Cr, and Cu ≤0.03, the alloy being homogenized at a temperature of greater than 550° C. up to 600° C. or less.

Patent applications US 2001/019777 and JP2001 220637 (Kobe Steel) describe an alloy for chambers comprising (as percentages by weight) Si: 0.1-2.0, Mg: 0.1-3.5; Cu: 0.02-4.0 and impurities, the Cr content being less than 0.04%. These documents disclose products obtained by performing a hot rolling stage before the solution heat treatment.

The international application WO2011/89337 (Constellium) describes a process for manufacturing cast not rolled products suitable for the fabrication of vacuum chamber elements, composed as follows (as percentages by weight), Si: 0.5-1.5, Mg: 0.5-1.5; Fe <0.3; Cu <0.2; Mn <0.8; Cr <0.10; Ti <0.15.

U.S. Pat. No. 6,066,392 (Kobe Steel) discloses an aluminium material having anodic oxidation film with improved corrosion resistance, wherein cracks are not generated even in high temperature thermal cycles and in corrosive environments.

U.S. Pat. No. 6,027,629 (Kobe Steel) describes an improved method of surface treatment for vacuum chamber elements wherein the pore diameter of the anodic oxide film is variable within the thickness thereof.

U.S. Pat. No. 7,005,194 (Kobe Steel) discloses an improved surface treatment method for vacuum chamber elements in which the anodized film is composed of a porous layer and a non-porous layer whose structure is at least partly boehmite or pseudo-boehmite.

Patent application WO2014/060660 (Constellium France) relates to a vacuum chamber element obtained by machining and surface treatment of a plate of thickness at least equal to 10 mm, made of aluminium alloy composed as follows (as percentages by weight), Si: 0.4-0.7, Mg: 0.4-0.7; Ti0.01-<0.15, Fe <0.25; Cu <0.04; Mn <0.4; Cr 0.01-<0.1; Zn <0.04; other elements <0.05 each and <0.15 in total, the rest aluminium.

These documents do not mention the problem of improving the resistance to creep deformation at high temperature.

There is a need for further improved vacuum chamber elements, particularly in terms of resistance to creep deformation at high temperature, while maintaining high properties of corrosion resistance, homogeneity of properties in thickness and machinability.

SUMMARY

Subject of the Invention

The first subject of the invention is a vacuum chamber element obtained by machining and surface treatment of a plate of thickness at least equal to 10 mm made of aluminium alloy composed as follows (as percentages by weight), Si: 0.4-0.7, Mg: 0.4-1.0; the Mg/Si ratio as a percentage by weight being less than 1.8; Ti: 0.01-0.15, Fe 0.08-0.25; Cu <0.35; Mn <0.4; Cr: <0.25; Zn <0.04; other elements <0.05 each and <0.15 in total, the rest aluminium, characterized in that the grain size of said plate is such that the mean linear intercept length $\bar{\ell}$, measured in plane L/TC measured according to standard ASTM E112, is at least equal to 350 μm between surface and mid-thickness.

The second subject of the invention is a method of manufacturing a vacuum chamber element in which successively a. an aluminium alloy rolling slab is cast, of composition (as percentages by weight) Si: 0.4-0.7, Mg: 0.4-1.0; the Mg/Si ratio as a percentage by weight being less than 1.8; Ti: 0.01-0.15, Fe 0.08-0.25; Cu <0.35; Mn <0.4; Cr <0.25; Zn <0.04; other elements <0.05 each and <0.15 in total, the rest aluminium,
b. optionally, said rolling slab is homogenized,
c. said rolling slab is rolled at a temperature above 400° C. to obtain a plate having a thickness at least equal to 10 mm,
d. said plate undergoes solution heat treatment, optionally preceded by a cold working operation, and is quenched,
e. after solution heat treatment and quenching, said plate is stress-relieved by controlled stretching with permanent elongation of 1 to 5%,
f. the stretched plate then undergoes ageing,
g. optionally, additional cold working of at least 3% and an annealing treatment at a temperature of at least 500° C. are carried out; the annealing treatment can be carried out before or after steps h or i of machining and surface treatment,
h. the aged plate is machined into a vacuum chamber element,
i. surface treatment of the vacuum chamber element obtained in this way, preferably comprising anodization carried out at a temperature of between 10 and 30° C., is performed with a solution comprising 100 to 300 g/l of sulphuric acid and 10 to 30 g/l of oxalic acid and 5 to 30 g/l of at least one polyol, said method comprising appropriate additional annealing and/or solution heat treatment and/or cold working and/or annealing steps to obtain a grain size such that the average linear intercept length $\bar{\ell}$, measured in plane L/TC according to standard ASTM E112, is at least 350 μm between surface and mid-thickness.

DETAILED DESCRIPTION OF A PREFERRED EMBODIMENT

Figure 1:
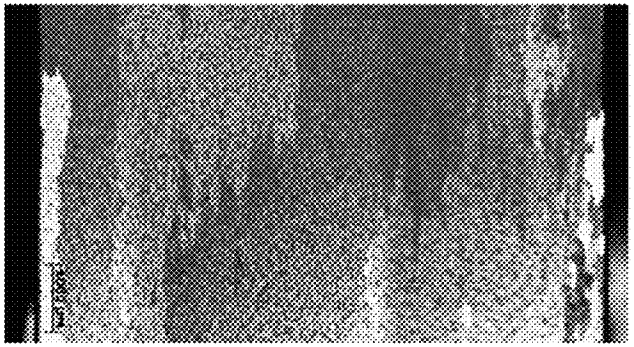
FIG. 1 shows the granular structure of product A obtained in example 1 on L/TC sections after Barker's etch.

The designation of alloys is compliant with the rules of The Aluminum Association (AA), known to experts in the field. The definitions of the metallurgical states are indicated in European standard EN 515. Unless otherwise specified, the definitions of standard EN12258-1 apply.

Unless otherwise specified, static tensile mechanical properties, in other words, the ultimate tensile strength Rm, the conventional yield stress at 0.2%, the elongation limit Rp0.2, and elongation at rupture A %, are determined by a tensile test according to standard ISO 6892-1, sampling and direction of testing being defined standard by EN 485-1. Hardness is measured according to standard EN ISO 6506.

Grain sizes are measured according to standard ASTM E112. Average grain sizes are measured in plane L/TC according to the intercepts method of standard (ASTM E112-96 § 16.3). The average linear intercept length is measured in the longitudinal direction $\bar{\ell}_{\ell(0°)}$ and the transverse direction $\bar{\ell}_{\ell(90°)}$. An average value in plane L/TC $\bar{\ell}$, named average linear intercept length in plane L/TC is calculated according to $\bar{\ell}=(\bar{\ell}_{\ell(0°)}\cdot\bar{\ell}_{\ell(90°)})^{1/2}$. The anisotropy index $AI_\ell$ is calculated according to $AI_\ell=\bar{\ell}_{\ell(0°)}/\bar{\ell}_{\ell(90°)}$. The variation in the thickness of $\bar{\ell}_{\ell(90°)}$, $\Delta\bar{\ell}_{\ell(90°)}$ is also calculated according to the formula:

$$\Delta\bar{\ell}_{\ell(90°)}=(\max(\bar{\ell}_{\ell(90°)}(S,\tfrac{1}{2}Th,\tfrac{1}{4}Th))-\min(\bar{\ell}_{\ell(90°)}(S,\tfrac{1}{2}Th,\tfrac{1}{4}Th)))/av(\bar{\ell}_{\ell(90°)}(S,\tfrac{1}{2}Th,\tfrac{1}{4}Th))$$

where S: means Surface, ½ Th means mid-thickness and ¼ Th means quarter-thickness. In the context of the present invention, the term "surface grain size" is understood to mean the grain size measured after machining enabling 2 mm to be removed in the direction of the thickness.

The electric breakdown voltage is measured according to EN ISO 2376: 2010.

The present inventors found that vacuum chamber elements having very advantageous properties in terms of resistance to high temperature creep deformation, while also having advantageous properties of corrosion resistance, uniformity of properties and machinability, are obtained for a specific aluminium alloy of the 6xxx series whose grain size is high and homogeneous in thickness with respect to known products according to the state of the art. A method of manufacturing a vacuum chamber element comprising steps for obtaining the grain size according to the invention has also been invented.

The composition of the aluminium alloy plates making it possible to obtain the vacuum chamber elements according to the invention is (as percentages by weight), Si: 0.4-0.7, Mg: 0.4-1.0; the Mg/Si ratio as a percentage by weight being less than 1.8; Ti: 0.01-0.15, Fe 0.08-0.25; Cu <0.35; Mn <0.4; Cr <0.25; Zn <0.04; other elements <0.05 each and <0.15 in total, the rest aluminium.

The contents of these elements, in combination with the grain size according to the invention, make it possible in particular to obtain a high resistance to high-temperature creep deformation.

Magnesium and silicon are the major additive elements in the alloy products according to the invention. Their content was carefully selected so as to obtain the adequate mechanical properties, especially tensile strength in direction TL of at least 260 MPa and/or a yield strength in direction TL of at least 200 MPa and also a homogeneous granular structure throughout the thickness. The silicon content lies between 0.4 and 0.7% by weight and preferably between 0.5 and 0.6% by weight. The magnesium content is between 0.4 and 1.0% by weight. Preferably the minimum magnesium content is 0.5% by weight. Preferentially, the maximum magnesium content is 0.7% by weight and preferably 0.6% by weight. In an advantageous embodiment, the magnesium content is 0.4 to 0.7% by weight and preferably 0.5 to 0.6% by weight. The preferred silicon and/or magnesium contents make it possible in particular to achieve, both on the surface and at mid-thickness, hydrogen bubble appearance durations in the bubble test which are particularly remarkable for the products according to the invention. In addition, the Mg/Si ratio as a percentage by weight must remain below 1.8 and preferably below 1.5. The present inventors have indeed found that if this ratio is too high, resistance to high temperature creep deformation decreases. The present inventors believe that an excessively high Mg content in solid solution could affect high temperature creep deformation resistance.

The present inventors have found that, surprisingly, too little iron affects high temperature creep deformation resistance. The minimum iron content is therefore 0.08% by weight and preferably 0.10% by weight. Too much iron can have an adverse effect on the properties of the anodic oxide layer. The iron content is therefore at most 0.25% by weight and preferably at most 0.20% by weight. In an advantageous embodiment of the invention, the iron content is from 0.10 to 0.20% by weight.

The addition of too much copper content may have an adverse effect on high temperature creep deformation resistance. The copper content is therefore less than 0.35% by weight. In addition, a high copper content may downgrade the properties of the protective oxide layer and/or contaminate the products manufactured in the vacuum chambers. Preferably the copper content is less than 0.05% by weight, preferentially less than 0.02% by weight and preferably less than 0.01% by weight.

An excessive amount of titanium may also have an adverse effect on the properties of the anodic oxide layer. The titanium content is therefore less than 0.15% by weight. However, the addition of a small amount of titanium has a favourable effect on the granular structure and its homogeneity, so the titanium content is at least 0.01% by weight. In an advantageous embodiment, the titanium content is 0.01 to 0.1% by weight and preferably 0.01 to 0.05% by weight. Advantageously, the titanium content is at least 0.02% by weight and preferentially at least 0.03% by weight.

Too much chromium can also have a detrimental effect on high temperature creep deformation resistance. The chromium content is therefore less than 0.25% by weight. However, the addition of a small amount of chromium may have a favourable effect on the granular structure, so the chromium content is preferably at least 0.01% by weight. In an advantageous embodiment, the chromium content is 0.01 to 0.04% by weight and preferably 0.01 to 0.03% by weight. The simultaneous addition of chromium and titanium is advantageous because it makes it possible to improve the granular structure and in particular to reduce the anisotropy index of the grains.

Controlling the maximum content of certain other elements is important because these elements can, if they are present at levels higher than those recommended, downgrade the properties of the anodic oxide layer and/or contaminate the products manufactured in the vacuum chambers. The manganese content is therefore less than 0.4% by weight, preferably less than 0.04% by weight and preferably less than 0.02% by weight. The zinc content is less than 0.04% by weight, preferably less than 0.02% by weight and preferably less than 0.001% by weight.

The aluminium alloy plates according to the invention are at least 10 mm thick. Advantageously, the aluminium alloy plates according to the invention are between 20 and 110 mm thick and preferably between 30 and 90 mm thick. In one embodiment of the invention, the aluminium alloy plates according to the invention are at least 50 mm thick and preferably at least 60 mm thick.

The plates according to the invention have a grain size such that the average linear intercept length $\bar{\ell}$, measured in plane L/TC according to standard ASTM E112, is at least equal to 350 μm between surface and mid-thickness, and preferably at least equal to 400 microns between surface and mid-thickness, which helps to obtain to high temperature creep deformation resistance. Advantageously, the grain size is particularly homogeneous in the thickness, and the plate is such that the variation in the thickness of the average linear intercept length in plane L/TC in the transverse direction, called $\ell_{\ell(90°)}$ according to standard ASTM E112, is less than 30% and preferably less than 20%. The variation of the grain size is calculated by taking the difference between the maximum value and the minimum value at mid-thickness, quarter-thickness and surface, and dividing by the average values at mid-thickness, quarter-thickness and surface. Preferably, the average linear intercept length measured in plane L/TC according to standard ASTM E112 in the transverse direction $\bar{\ell}_{\ell(90°)}$ is at least 200 μm and preferably at least 230 μm between surface and mid-thickness. The plates according to the invention have high temperature creep deformation resistance. Advantageously therefore, creep deformation under a stress of 5 MPa at 420° C. is, after 10 hours, at most 0.40% and preferably at most 0.27%.

Plates according to the invention are suitable for machining. The stored elastic energy density $W_{tot}$, measurement of which is described in example 1, for plates according to the invention whose thickness is between 20 and 80 mm is therefore advantageously less than 0.2 kJ/m 3.

The vacuum chamber elements according to the invention are obtained by a process in which a. an aluminium alloy rolling slab is cast, of composition according to the invention,
b. optionally, said rolling slab is homogenized,
c. said rolling slab is rolled at a temperature above 400° C. to obtain a plate having a thickness at least equal to 10 mm,
d. said plate undergoes solution heat treatment, optionally preceded by a cold working operation, and is quenched,
e. after solution heat treatment and quenching, said plate is stress-relieved by controlled stretching with permanent elongation of 1 to 5%,
f. the stretched plate then undergoes ageing,
g. optionally, additional cold working of at least 3% and an annealing treatment at a temperature of at least 500° C. are carried out; the annealing treatment can be carried out before or after steps h or i of machining and surface treatment,
h. the aged plate is machined into a vacuum chamber element,
i. surface treatment of the vacuum chamber element obtained in this way, preferably comprising anodization carried out at a temperature of between 10 and 30° C., is performed with a solution comprising 100 to 300 g/l of sulphuric acid and 10 to 30 g/l of oxalic acid and 5 to 30 g/l of at least one polyol, the method comprising appropriate additional annealing and/or solution heat treatment and/or cold working and/or annealing steps to obtain a grain size such that the average linear intercept length $\bar{\ell}$, measured in plane L/TC according to standard ASTM E112, is at least 350 μm between surface and mid-thickness.

Homogenization is advantageous; it is preferably carried out at a temperature between 540° C. and 600° C. Preferably, the homogenization time is at least 4 hours.

When homogenization is carried out, the slab can be cooled after homogenization and then reheated before hot rolling or rolled directly without intermediate cooling.

The hot rolling conditions are important to obtain the desired microstructure, in particular to improve the corrosion resistance of the products. In particular, the rolling slab is maintained at a temperature above 400° C. throughout the hot rolling process. Preferably, the temperature of the metal is at least 450° C. during hot rolling. The plates according to the invention are laminated to a thickness of at least 10 mm.

The plate then undergoes solution heat treatment, optionally preceded by a cold working operation, and is quenched, Quenching can be performed in particular by spraying or immersion. The solution heat treatment is preferably carried out at a temperature between 540° C. and 600° C. Preferentially the dissolution time is at least 15 min, the time being adapted according to the thickness of the products.

The plate having undergone solution heat treatment is then stress relieved by controlled stretching with a permanent elongation of 1 to 5%.

The stretched plate then undergoes ageing. The ageing temperature is advantageously between 150° C. and 190° C. Ageing time is typically between 5 h and 30 h. Preferably ageing is performed at the peak to achieve maximum yield strength and/or a T651 state.

Optionally, additional cold working of at least 3% and an annealing treatment at a temperature of at least 500° C. are carried out; the annealing treatment can be carried out before or after machining and surface treatment steps.

To obtain a grain size according to the invention rolling and/or solution heat treatment and/or additional cold working and annealing steps are appropriate.

In a first embodiment, the rolling temperature is maintained at a temperature above 500° C. and preferably above 525° C. during all rolling steps. Advantageously in this first embodiment, the natural logarithm of the Zener-Hollomon parameter Z defined by equation (1), In Z is between 21 and 25 and preferably between 21.5 and 24.5 for the majority of passes and preferably for all passes made during hot rolling.

$$Z=\dot{\varepsilon}e^{Q/(RT)} \quad (1)$$

where $\dot{\varepsilon}$ is the average strain rate in the thickness expressed in $s^{-1}$, Q is the activation energy of 156 kJ/mol, R is the ideal gas constant 8.31 $JK^{-1}$ $mol^{-1}$, T is the rolling temperature expressed in Kelvin.

In this first embodiment the last rolling pass is advantageously such that L/H is at least 0.6 where H is the thickness at the rolling mill intake and L is the contact length in the rolling mill.

In a second embodiment, the time and/or the solution heat treatment temperature are modified with respect to the time and/or the solution heat treatment temperature necessary to solution heat treat the alloy elements, so as to obtain grain growth. Typically, the time used is at least double and/or the temperature is at least 10° C. higher than the time and/or the solution heat treatment temperature necessary to solution heat treat the alloy elements.

In a third embodiment, solution heat treatment is preceded by cold working by rolling or stretching with a deformation of at least 4% and preferably at least 7%.

In a fourth embodiment, additional cold working of at least 3% is carried out after the ageing step and annealing treatment at a temperature of at least 500° C., and preferably at least 525° C.; the annealing treatment can be performed before or after the machining or surface treatment steps.

The four embodiments may be combined to obtain the grain size according to the invention. A vacuum chamber element is obtained by machining and surface treatment of a plate of thickness at least equal to 10 mm according to the invention.

The surface treatment preferably comprises anodizing treatment to obtain an anodic layer whose thickness is typically between 20 and 80 μm.

The surface treatment preferably includes, before anodizing, degreasing and/or pickling with known products, typically alkaline products. Degreasing and/or pickling may include a neutralization operation particularly in the event of alkaline pickling, typically with an acid such as nitric acid, and/or at least one rinsing stage.

Anodizing is carried out using an acid solution. It is advantageous for the surface treatment to include hydration after anodizing (also called "sealing") of the anodic layer obtained.

In an advantageous embodiment, anodization takes place at a temperature between 10 and 30° C. with a solution comprising 100 to 300 g/l of sulphuric acid and 10 to 30 g/l of oxalic acid and 5 to 30 g/l of at least one polyol, and advantageously the product anodized in this way is hydrated in deionized water at a temperature of at least 98° C., preferably for a period of at least about 1 hour. These advantageous anodizing conditions make it possible to achieve, both on the surface and at mid-thickness, hydrogen bubble appearance durations in the bubble test which are particularly remarkable, in particular for the products preferred according to the invention, the Mg content of which is between 0.4 and 0.7% by weight, the Si content is between 0.4 and 0.7% by weight and the Cu content is less than 0.05% by weight for which bubble test durations are preferably at least 750 minutes.

Preferentially, the aqueous solution used to anodize this advantageous surface treatment does not contain a titanium salt. The presence of at least one polyol in the anodizing solution also contributes to improving the corrosion resistance of the anodic layers. Ethylene glycol, propylene glycol or preferably glycerol are advantageous polyols. Anodizing is preferably carried out with a current density of between 1 and 5 A/dm$^2$. Anodizing time is determined so as to reach the desired anodic layer thickness.

After anodizing, it is advantageous to perform a hydration stage (also called sealing) on the anodic layer. Preferably hydration is carried out in deionized water at a temperature of at least 98° C. preferably for a period of at least about 1 hour. The present inventors have observed that it is particularly advantageous to carry out hydration after anodization in two steps in deionized water: a first step lasting at least 10 minutes at a temperature of 20 to 70° C. and a second step of at least about 1 hour at a temperature of at least 9° C. Advantageously, a triazine-derived anti-dust additive such as Anodal-SH1® is added to the deionized water used for the second step of the hydration.

Vacuum chamber elements treated with the advantageous surface treatment method and obtained from plates whose thickness is between 20 and 80 mm easily reach at mid-thickness hydrogen bubble appearance durations in a 5% hydrochloric acid solution ("bubble test") of at least about 400 min and preferably at least 750 min and even at least about 900 min, at least for the part corresponding to the surface of the plate. Vacuum chamber elements obtained from an alloy plate according to the invention, the thickness of which is between 60 and 80 mm, and with the advantageous surface treatment method can, on the surface of the plate, reach hydrogen bubble appearance durations in a 5% hydrochloric acid solution of at least 500 min and preferably at least 900 min at mid-thickness.

The preferred products according to the invention, the Mg content of which is between 0.4 and 0.7% by weight, the Si content is between 0.4 and 0.7% by weight and the Cu content is lower than 0.05% by weight, reach, at mid-thickness, hydrogen bubble appearance durations in a 5% hydrochloric acid solution ("bubble test") of at least 750 min and a creep deformation under a stress of 5 MPa at 420° C. is after 10 hours at most 0.27%.

The use of vacuum chamber elements according to the invention in vacuum chambers is particularly advantageous because their properties are very homogeneous and in addition, especially for elements anodized with the advantageous surface treatment process, corrosion resistance is high, which prevents contamination of the products manufactured in the chambers such as, for example, microprocessors or faceplates for flat screens.

EXAMPLES

Example 1

In this example 6xxx alloy plates of thickness 16 mm were prepared.

Slabs were cast: their composition is given in Table 1

TABLE 1

Composition of alloys (% by weight)

| Alloy | Si | Fe | Cu | Mn | Mg | Cr | Ti | Mg/Si |
|---|---|---|---|---|---|---|---|---|
| A (Invention) | 0.6 | 0.23 | 0.30 | 0.12 | 1.0 | 0.20 | 0.06 | 1.7 |
| B (Reference) | 0.6 | 0.23 | 0.29 | 0.12 | 1.2 | 0.20 | 0.07 | 2.0 |
| C (Reference) | 0.4 | 0.24 | 0.29 | 0.12 | 1.0 | 0.19 | 0.06 | 2.5 |
| D (Reference) | 0.6 | 0.07 | 0.29 | 0.12 | 1.0 | 0.20 | 0.06 | 1.7 |
| E (Reference) | 0.6 | 0.06 | 0.29 | <0.01 | 1.0 | 0.30 | 0.06 | 1.7 |

The slabs were homogenized at a temperature of 560° C. for 2 hours, hot rolled to a thickness of 16 mm at a temperature of at least 400° C. The plates obtained in this way were underwent solution heat treatment for 2 hours at a temperature of 575° C. (A, D, E), 545° C. (C) or 570° C. (B) appropriate for their composition, quenched and stretched. The plates obtained underwent suitable ageing to reach a T651 state. The duration and the temperature of the solution heat treatment were intended to obtain a grain size such that the mean linear intercept length in plane L/TC measured according to standard ASTM E112, named $\ell$, is at least equal to 350 μm between surface and mid-thickness. The micrograph obtained for plate A, representative of all the plates, is shown in FIG. 1.

Figure 2:
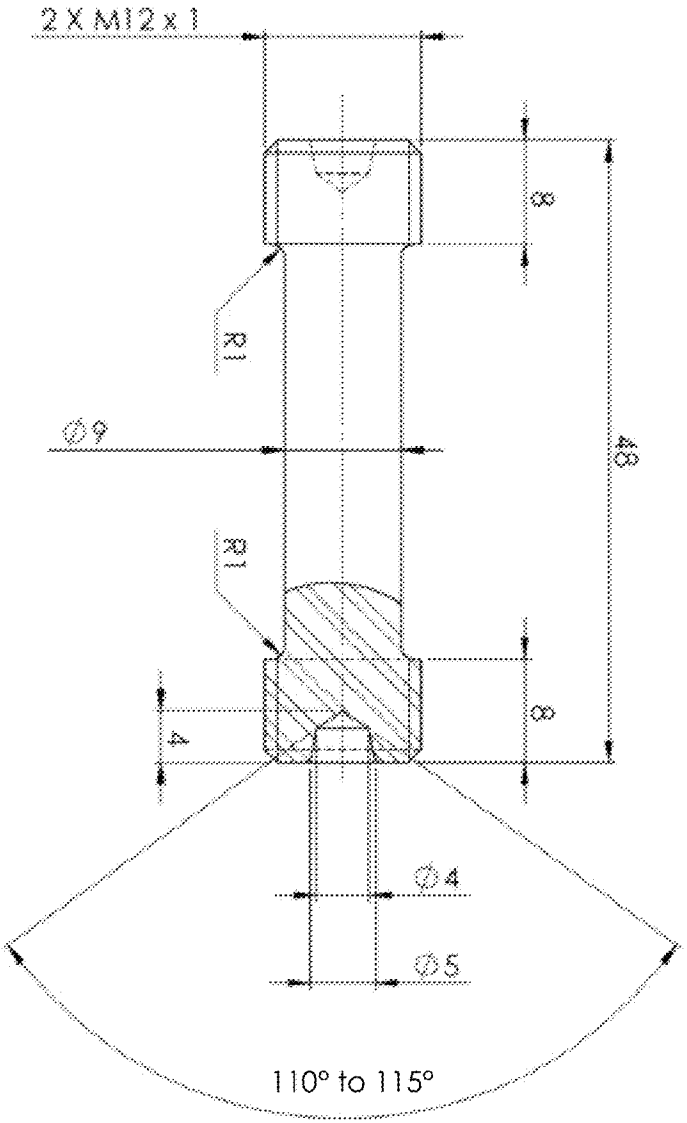
FIG. 2 shows the geometry of the specimen used for the creep hot working tests.

The resistance to creep deformation at high temperature was evaluated on specimens as described in FIG. 2, at a temperature of 420° C. under a stress of 5 MPa. Deformation after 10 hours is given in Table 2

TABLE 2

Deformation after 10 h of creep test at 420° C. under a stress of 5 MPa.

| Alloy | Deformation (%) |
|---|---|
| A (Invention) | 0.15 |
| B (Reference) | 0.29 |
| C (Reference) | 0.45 |
| D (Reference) | 0.46 |
| E (Reference) | 0.61 |

Plate A underwent machining and surface treatment. In the surface treatment the product is degreased, pickled with an alkaline solution, then neutralized with a nitric acid solution before being anodized at a temperature of about 20° C. in an sulphuric/oxalic bath (sulphuric acid 160 g/l+oxalic acid 20 g/l+15 g/l glycerol). After anodizing, a hydration treatment of the anodic layer was performed in two steps: 20 min at 50° C. in deionized water and then about 80 min in boiling deionized water in the presence of an anodal-SH1® triazine anti-dust additive. The anodic layer obtained had a thickness of about 50 μm.

The anodic layer obtained was characterized by the following tests.

The electric breakdown voltage characterizes the voltage at which the first electric current flows through the anodic layer. The measurement method is described in standard EN ISO 2376: 2010. The value obtained was 2.6 kV.

The "bubble test" is a corrosion test for characterizing the quality of the anodic layer by measuring the time it takes for the first bubbles to appear in a solution of hydrochloric acid. A flat surface 20 mm in diameter of the sample is put into contact at room temperature with a solution containing 5% by weight of HCl. The characteristic time is the time from which a continuous stream of bubbles of gas from at least one discrete point of the surface of the anodized aluminium is visible. The result obtained was 450 minutes.

Example 2

In this example alloy plates of composition as indicated in Table 3 and thickness 280 mm were prepared by homogenization and hot rolling at a temperature greater than 400° C.

TABLE 3

| composition of the alloy (% by weight) | | | | | | | | |
|---|---|---|---|---|---|---|---|---|
| Alloy | Si | Fe | Cu | Mn | Mg | Cr | Ti | Mg/Si |
| F | 0.56 | 0.13 | 0.011 | 0.016 | 0.54 | 0.021 | 0.018 | 1 |

A plate F-1 was then stretched by 8% while the other, F-2, did not receive this treatment. The plates obtained in this way underwent solution heat treatment for 6 hours at a temperature of 500 C, were quenched and triturated. The plates obtained underwent suitable ageing to reach a T651 state.

Figure 3A:
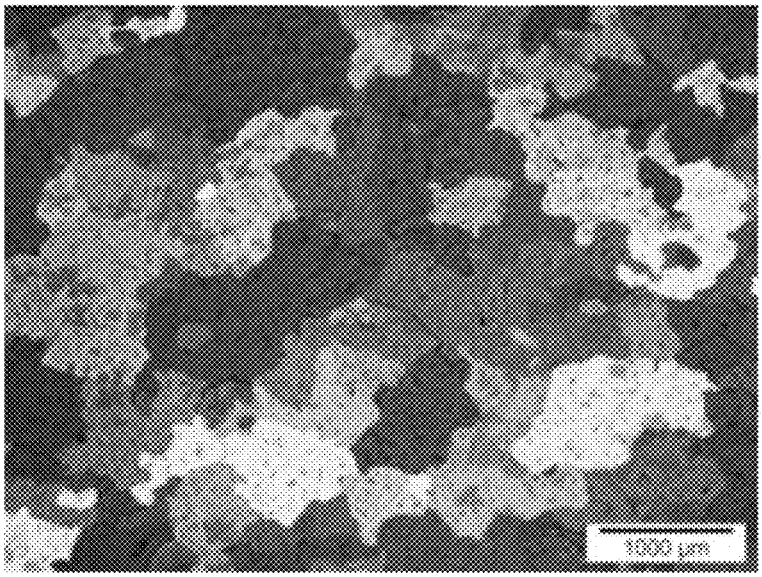
FIG. 3 shows the granular structure of product F-1 (FIG. 3A) and F-2 (FIG. 3B) obtained in example 2 on L/TC sections after Barker's etch.
Figure 3B:
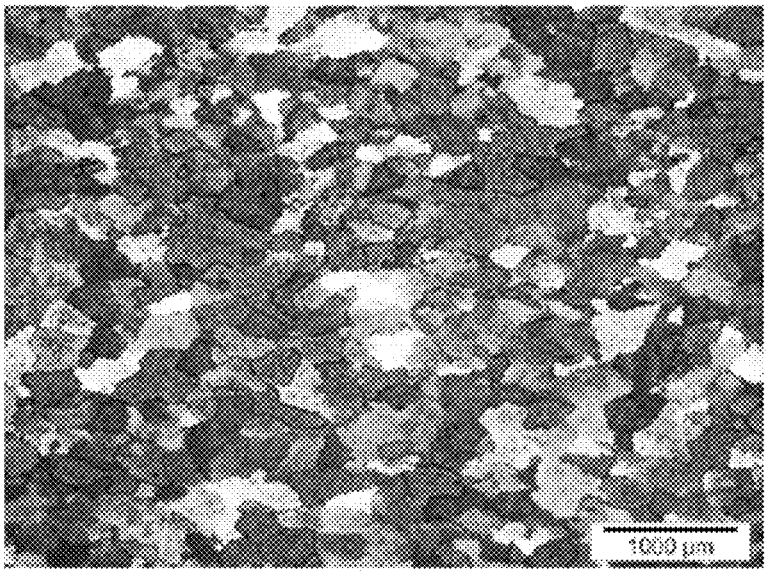

The granular structure of the various products obtained was observed at mid-thickness on L/TC sections by optical microscopy after Barker's etch. The micrographs are shown in FIG. 3A (plate F1) and 3B (plate F-2).

The grain sizes measured in plane L-TC are shown in Table 4

TABLE 4

| grain size in the plane L-TC (μm) | | | | | |
|---|---|---|---|---|---|
| Alloy | Position | $\bar{\ell}$ $\ell$ (90°) μm | $\bar{\ell}$ $\ell$ (0°) μm μm | $\bar{\ell}$ μm | $AI_\ell$ (L/TC) |
| F1 | ½ thickness | 435 | 567 | 497 | 1.3 |
| F2 | ½ thickness | 223 | 359 | 283 | 1.6 |

The resistance to creep deformation at high temperature was evaluated on specimens as described in FIG. 2, at a temperature of 420° C. under a stress of 5 MPa. Deformation after 10 hours is given in Table 5.

TABLE 5

| Deformation after 10 h of creep test at 420° C. under a stress of 5 MPa. | |
|---|---|
| Alloy | Deformation (%) |
| F-1 (Invention) | 0.08% |
| F-2 (Reference) | 0.7% |

Example 3

In this example 6xxx alloy plates of thickness 64 mm were prepared.

Slabs were cast: their composition is given in Table 6

TABLE 6

| Composition of alloys (% by weight) | | | | | | | | |
|---|---|---|---|---|---|---|---|---|
| Alloy | Si | Fe | Cu | Mn | Mg | Cr | Ti | Mg/Si |
| G | 0.6 | 0.14 | <0.01 | <0.01 | 0.6 | 0.02 | 0.04 | 1.0 |
| H | 0.5 | 0.13 | <0.01 | <0.01 | 0.5 | 0.04 | 0.03 | 1.0 |

The slabs were homogenized at a temperature of 595° C. for 12 hours.

Slab G was hot rolled to a thickness of 64 mm at a temperature of at least 530° C. and maintaining the Zener-Hollomon parameter for each rolling pass such that ln Z is between 22 and 24. 5.

Slab H was hot-rolled to a thickness of 64 mm at a temperature of between 480 and 500° C., the Zener-Hollomon parameter being such that ln Z was greater than 26 for the majority of the rolling passes.

The plates obtained in this way underwent solution heat treatment for 4 hours at a temperature of 535° C. and stretched by 3%. The plates obtained underwent suitable ageing to reach a T651 state.

The mechanical properties in direction TL were measured at quarter-thickness and are shown in Table 7

TABLE 7

| Quarter-thickness mechanical properties in direction TL | | | |
|---|---|---|---|
| Alloy | Rp0,2 (MPa) | Rm (MPa) | A (%) |
| G | 268 | 289 | 7.2 |
| H | >220 | >260 | >5 |

The resistance to creep deformation at high temperature was evaluated on specimens as described in FIG. 2, at a temperature of 420° C. under a stress of 5 MPa. Deformation after 10 hours is given in Table 8.

TABLE 8

| Deformation after 10 h of creep test at 420° C. under a stress of 5 MPa. | |
|---|---|
| Alloy | Deformation (%) |
| G | 0.26% |
| H | 2.5% |

Figure 4:
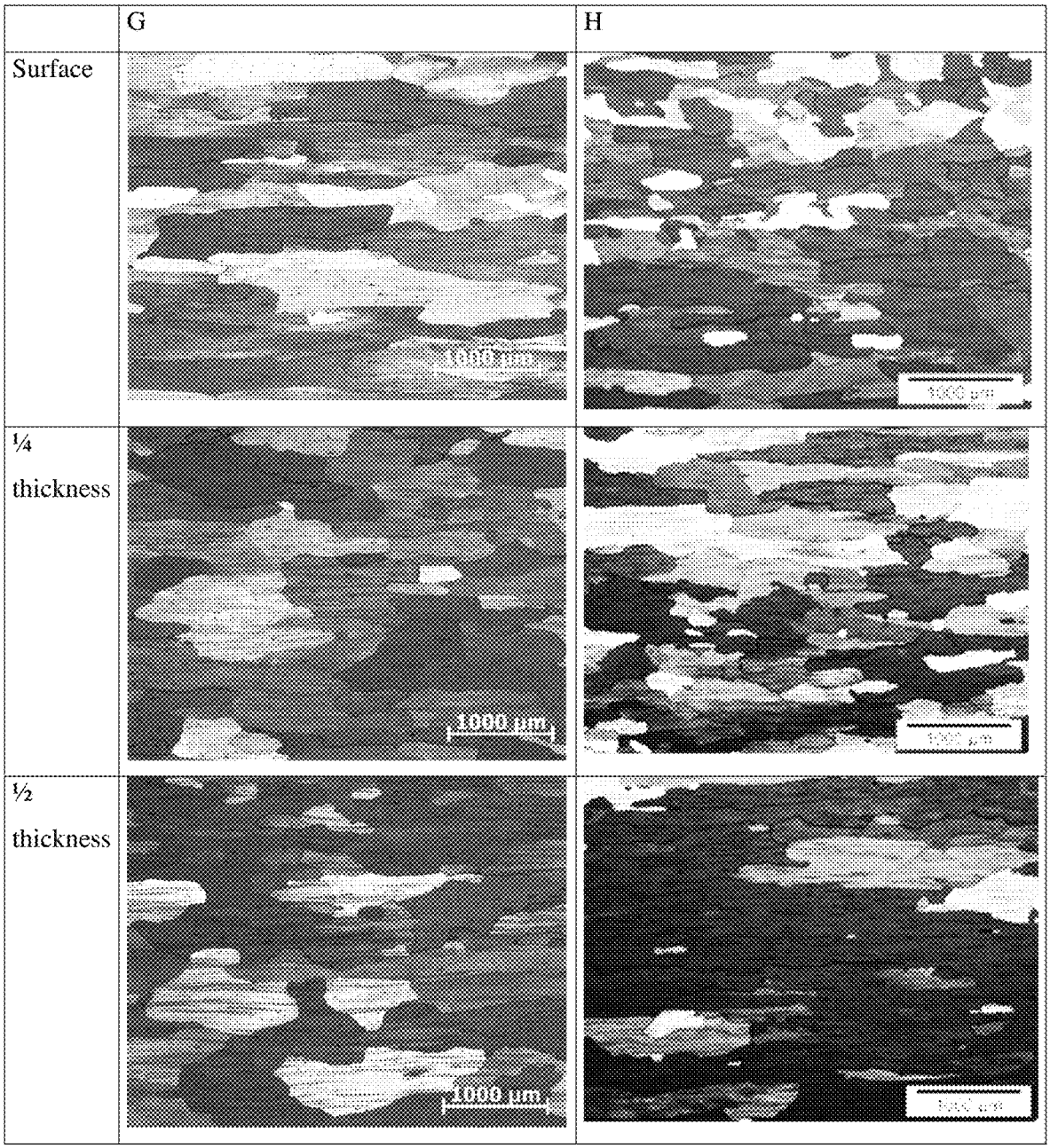
FIG. 4 shows the granular structure of products G and H obtained in example 3 on L/TC sections after Barker's etch, on the surface at quarter-thickness and mid-thickness.

The granular structure of the various products obtained was observed on sections L/TC by optical microscopy after Barker's etch, on the surface and at quarter and mid-thickness. Micrographs are shown in FIG. 4.

Average grain sizes measured in plane L/TC according to the intercepts method of standard (ASTM E112-96 § 16.3) are shown in Table 9.

TABLE 9

| grain size in the plane L-TC (μm) | | | | | | |
|---|---|---|---|---|---|---|
| Alloy | Position | $\ell_\ell$ (90°) μm | $\ell_\ell$ (0°) μm | $\bar{\ell}$ μm | $AI_\ell$ (L/TC) | Δ $\bar{\ell}_\ell$ (90°) |
| G | Surface | 246 | 770 | 435 | 3.1 | 14% |
| | ¼ thickness | 264 | 682 | 424 | 2.6 | |
| | ½ thickness | 284 | 732 | 456 | 2.6 | |
| H | Surface | 185 | 364 | 259 | 2.0 | 31% |
| | ¼ thickness | 226 | 688 | 394 | 3.0 | |
| | ½ thickness | 254 | 738 | 433 | 2.9 | |

It is found that product G according to the invention has a larger grain size than product H and is also more homogeneous in its thickness.

The residual stresses in the thickness were evaluated using the rectangular bar step-by-step machining method taken from the full thickness in directions L and TL, described for example in the publication "Development of New Alloy for Distortion Free Machined Aluminum Aircraft Components", F. Heymes, B. Commet, B. Dubost, P. Lassince, P. Lequeu, G M. Raynaud, in 1st International Non-Ferrous Processing & Technology Conference, 10-12 Mar. 1997—Adams's Mark Hotel, St Louis, Mo.

This method applies mainly to slabs whose length and width are significantly greater than their thickness and for which the residual stress state can be reasonably considered to be biaxial with its two principal components in directions L and T (i.e. no residual stress in direction S) and such that the level of residual stresses varies only in direction S. This method is based on measurement of the deformation of two full-thickness rectangular bars which are cut from the slab along directions L and TL. These bars are machined downwards in direction S step by step, and at each step the curvature is measured, as well as the thickness of the machined bar.

The bar width was 30 mm. The bar must be long enough to avoid any edge effect on the measurements. A length of 400 mm was used.

The measurements were performed after each machining pass.

After each machining pass, the bar is removed from the vice, and a stabilization time is observed before the deformation measurement is performed, so as to obtain a homogeneous temperature in the bar after machining.

At each step i, the thickness h(i) of each bar and the curvature f(i) of each bar are collected.

These data make it possible to calculate the profile of residual stresses in the bar, corresponding to stress$\sigma(i)_L$ and to stress $\sigma(i)_{LT}$ in the form of an average in the layer removed during the i step, given by the following formulas, in which E is Young's modulus, lf is the length between the supports used for the warpage measurement and v is Poisson's ratio:

$$\text{from } i = 1 \text{ to } N-1$$

$$u(i)_L = -E\frac{4}{3}\frac{E}{lf^2}[f(i+1)_L - f(i)_L]\frac{h^3(i+1)}{h(i)h(i) - (h(i+1))} - S(i)_L$$

$$S(i)_L = \frac{4E}{lf^2}\sum_{k=1}^{i-1}[f(k+1)_L - f(k)_L]\left[-(h(i) + (h(i+1)) + \frac{h(k+1)(3h(k) - h(k+1))}{3h(k)}\right]$$

$$\sigma(i)_L = \frac{u(i)_L + vu(i)_{LT}}{1 - v^2}$$

$$\sigma(i)_{LT} = \frac{u(i)_{LT} + vu(i)_L}{1 - v^2}$$

Finally, the density of elastic energy stored in the bar $W_{tot}$ can be calculated from the residual stress values using the following formulae:

$$W_{tot} = W_L + W_{LT}$$

with $$W_L(kJ/m^3) = \frac{500}{Eth}\sum_{i=1}^{N-1}\sigma_L(i)[\sigma_L(i) - v\sigma_{LT}(i)]dh(i)$$

$$W_{LT}(kJ/m^3) = \frac{500}{Eth}\sum_{i=1}^{N-1}\sigma_{LT}(i)[\sigma_{LT}(i) - v\sigma_L(i)]dh(i)$$

Figure 5:
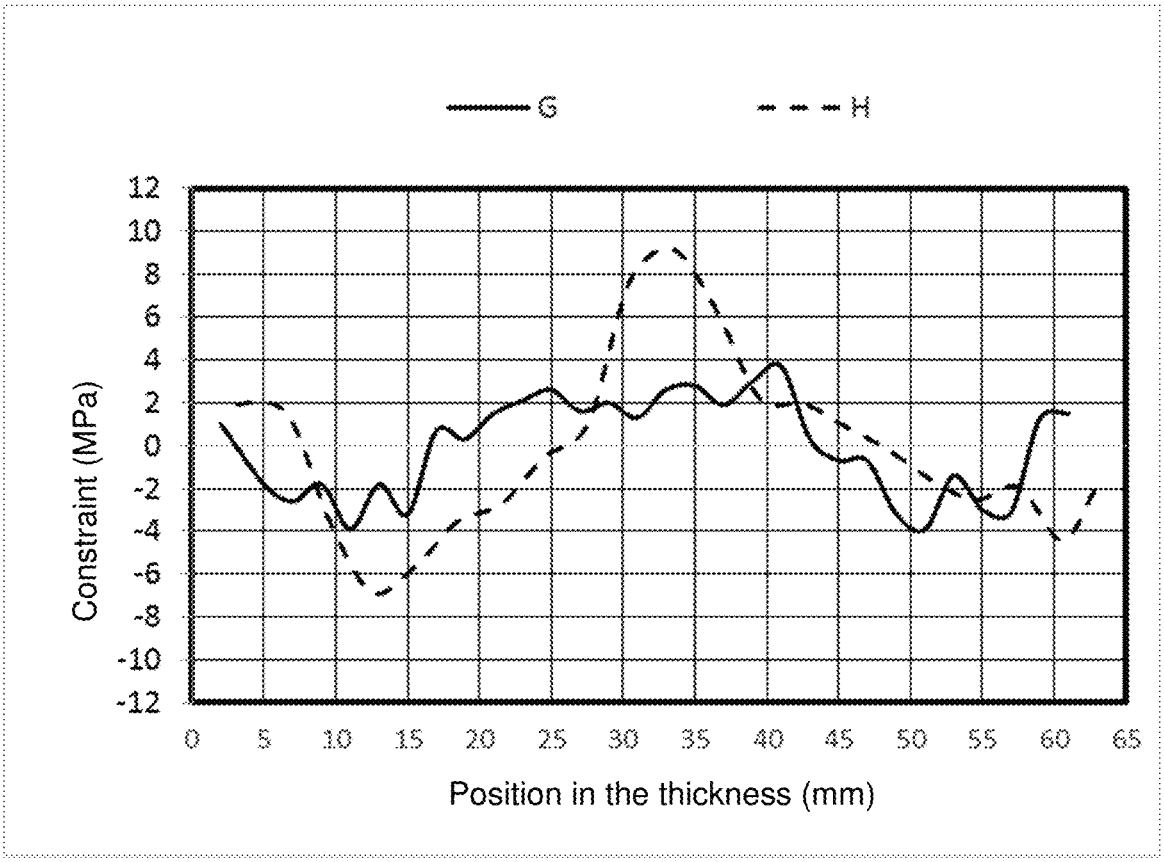
FIG. 5 shows the stress profile in the thickness for direction L for the products obtained in example 3.

The stress profile in the thickness for direction L is given in FIG. 5.

Total energy measured $W_{tot}$ was 0.18 kJ/m$^3$ for sample G and 0.17 kJ/m$^3$ for sample H.

The products underwent machining and surface treatment. In the surface treatment the product is degreased, pickled with an alkaline solution, then neutralized with a nitric acid solution before being anodized at a temperature of about 20° C. in an sulphuric/oxalic bath (sulphuric acid 160 g/l+oxalic acid 20 g/l+15 g/l glycerol). After anodizing, a hydration treatment of the anodic layer was performed in two steps: 20 min at 50° C. in deionized water and then about 80 min in boiling deionized water in the presence of an anodal-SH1® triazine anti-dust additive. The anodic layer obtained had a thickness of about 50 μm.

The anodic layers were characterized by the following tests.

The electric breakdown voltage characterizes the voltage at which the first electric current flows through the anodic layer. The measurement method is described in standard EN ISO 2376: 2010. The values are given in absolute value after DC measurement.

The "bubble test" is a corrosion test for characterizing the quality of the anodic layer by measuring the time it takes for the first bubbles to appear in a solution of hydrochloric acid. A flat surface 20 mm in diameter of the sample is put into contact at room temperature with a solution containing 5% by weight of HCl. The characteristic time is the time from which a continuous stream of bubbles of gas from at least one discrete point of the surface of the anodized aluminium is visible.

The results measured on the surface and at mid-thickness are presented in Table 10.

TABLE 10

Characterization of the products after anodizing

| Position | Product | Bubble test (min) | Breakdown voltage (KV) |
|---|---|---|---|
| Surface | G | 1020 | 2.0 |
| | H | 1380 | 2.6 |
| ¼ thickness | G | >1440 | 2.0 |
| | H | >1500 | 3.3 |
| ½ thickness | G | 900 | 2.0 |
| | H | 1320 | 2.8 |

The product according to the invention has excellent properties after surface treatment.

The invention claimed is:

1. Vacuum chamber element obtained by machining and surface treatment of a plate of thickness at least equal to 10 mm made of aluminium alloy composed as follows (as percentages by weight), Si: 0.4-0.7, Mg: 0.4-1.0; the Mg/Si ratio as a percentage by weight being less than 1.8; Ti: 0.01-0.15, Fe 0.08-0.25; Cu <0.35; Mn <0.4; Cr: <0.25; Zn <0.04; other elements <0.05 each and <0.15 in total, the rest aluminium, wherein the grain size of said plate is such that the mean linear intercept length $\ell$, measured in plane L/TC according to standard ASTM E112, is at least equal to 350 μm between surface and ½ thickness.

2. The element according to claim 1 wherein the grain size of said plate is such that the variation in the thickness of the average linear intercept length in plane L/TC in the transverse direction, called $\bar{\ell}_{1(90°)}$ according to standard ASTM E112, is less than 30%.

3. The element according to claim 1 wherein the creep deformation at a temperature of 420° C. under a stress of 5 MPa is at most 0.40% after 10 hours.

4. The element according to claim 1 wherein the magnesium content is 0.4 to 0.7 as percentage by weight.

5. The element according to claim 1 wherein the copper content is less than 0.05% by weight.

6. The element according to claim 1 wherein said plate is such that a thickness thereof is between 20 and 80 mm and stored elastic energy density $W_{tot}$ is less than 0.2 kJ/m$^3$.

7. The element according to claim 1 wherein said surface treatment comprises anodization carried out at a temperature between 10 and 30° C. with a solution comprising 100 to 300 g/l of sulphuric acid and 10 to 30 g/l of oxalic acid and 5 to 30 g/l of at least one polyol and wherein said plate is such that a thickness thereof is between 20 and 80 mm, that it has at mid-thickness a hydrogen bubble appearance duration in a 5% hydrochloric acid solution greater than 400 min.

8. The element according to claim 7 wherein the Mg content is between 0.4 and 0.7% by weight, the Si content is between 0.4 and 0.7% by weight and the Cu content is lower than 0.05% by weight for which at mid-thickness the hydrogen bubble appearance duration in a 5% hydrochloric acid solution ("bubble test") is at least 750 min and for which the creep deformation under a stress of 5 MPa at 420° C. is after 10 hours at most 0.27%.

9. The element according to claim 7, wherein said plate is such that a thickness thereof is greater than 60 mm and has at a surface thereof, a hydrogen bubble appearance duration in a solution of 5% hydrochloric acid of at least 500 min.

10. The element according to claim 1 wherein the grain size of said plate is such that the variation in the thickness of the average linear intercept length in plane L/TC in the transverse direction, called $\ell_{1(90°)}$ according to standard ASTM E112, is less than 20%.

11. The element according to claim 1 wherein the creep deformation at a temperature of 420° C. under a stress of 5 MPa is at most 0.27% after 10 hours.

12. The element according to claim 1 wherein the magnesium content is 0.5 to 0.6 as percentage by weight.

13. The element according to claim 1 wherein the copper content is less than 0.01% by weight.

14. The method of manufacturing a vacuum chamber element wherein successively a. an aluminium alloy rolling slab is cast, of composition (as percentages by weight) Si: 0.4-0.7, Mg: 0.4-1.0; the Mg/Si ratio as a percentage by weight being less than 1.8; Ti: 0.01-0.15, Fe 0.08-0.25; Cu <0.35; Mn <0.4; Cr <0.25; Zn <0.04; other elements <0.05 each and <0.15 in total, the rest aluminium, b. optionally, said rolling slab is homogenized, c. said rolling slab is rolled at a temperature above 400° C. to obtain a plate having a thickness at least equal to 10 mm, d. said plate undergoes solution heat treatment, optionally preceded by a cold working operation, and is quenched, e. after solution heat treatment and quenching, said plate is stress-relieved by controlled stretching with permanent elongation of 1 to 5%, f. the stretched plate then undergoes ageing, g. optionally, additional cold working of at least 3% and an annealing treatment at a temperature of at least 500° C. are carried out; the annealing treatment can be carried out before or after steps h or i of machining and surface treatment, h. the aged plate is machined into a vacuum chamber element, i. surface treatment of the vacuum chamber element obtained, optionally comprising anodization carried out at a temperature of between 10 and 30° C., is performed with a solution comprising 100 to 300 g/l of sulphuric acid and 10 to 30 g/l of oxalic acid and 5 to 30 g/l of at least one polyol, said method comprising appropriate additional annealing and/or solution heat treatment and/or cold working and/or annealing steps to obtain a grain size such that the average linear intercept length $\ell$, measured in plane L/TC according to standard ASTM E112, is at least 350 μm between surface and mid-thickness.

15. The method according to claim 14 wherein the rolling temperature is maintained at a temperature above 500° C.

16. The method according to claim 15 wherein the natural logarithm of the Zener-Hollomon parameter Z defined by equation (1), $$Z=\dot{\varepsilon}e^{Q/(RT)} \quad (1),$$

ln Z is between 21 and 25 for a majority of passes made during hot rolling.

17. The method according to claim 16, wherein ln Z is between 21.5 and 24.5 for a majority of passes made during hot rolling.

18. The method according to claim 14 wherein solution heat treatment is preceded by cold working by rolling or stretching with a deformation of at least 4%.

19. The method according to claim 14 wherein additional cold working of at least 3% is carried out after the ageing and annealing treatment at a temperature of at least 500° C.; the annealing treatment can be performed before or after the machining and surface treatment.

20. The method according to claim 14 wherein the rolling temperature is maintained at a temperature above 525° C.

* * * * *